United States Patent [19]

Bartlett et al.

[11] Patent Number: 4,842,042

[45] Date of Patent: Jun. 27, 1989

[54] THICKNESS CONTROL OF DIRECT CAST STRIP

[75] Inventors: Edwin S. Bartlett, Worthington; James L. McCall, Columbus, both of Ohio

[73] Assignee: Battelle Development Corporation, Columbus, Ohio

[21] Appl. No.: 164,710

[22] Filed: Mar. 7, 1988

[51] Int. Cl.[4] ..... B22D 11/06

[52] U.S. Cl. ..... 164/463; 164/423; 164/428; 164/480; 164/479; 164/429

[58] Field of Search ..... 164/428, 480, 429, 479, 164/423, 463

[56] References Cited

U.S. PATENT DOCUMENTS 3,322,184 5/1967 Coffer et al. ..... 164/433

FOREIGN PATENT DOCUMENTS 59-13551 1/1984 Japan ..... 164/429

*Primary Examiner*—Kuang Y. Lin

*Attorney, Agent, or Firm*—Barry S. Bissell

[57] ABSTRACT

A smooth roll skimmer 36 may be used in the casting of strip 34 by the melt drag process to provide gauge control and a smooth upper surface. Liquid melt 32 is cast on the moving chilled substrate 33 where it solidifies to a strip. The skimmer 36 is positioned above the substrate 33 and at a fixed gap therefrom by convenient means, e.g., by a rolling spacer 37 between the casting surface and the roll skimmer. The roll skimmer is not chilled and is not used to solidify the liquid. It meters and smooths the liquid prior to solidification on the substrate. A parting agent may be used on the roll skimmer to prevent sticking and to reduce heat transfer. A carbonaceous soot from a partially combusted hydrocarbon fuel is a useful parting agent.

15 Claims, 4 Drawing Sheets

THICKNESS CONTROL OF DIRECT CAST STRIP

FIELD OF INVENTION

The invention relates to the direct casting of metal strip from a molten mass of the metal. As is known in the art, an open tundish can be used as a repository of molten metal spaced closely adjacent to a chilled casting wheel. The casting wheel surface rotates through the melt pool dragging a thin layer of melt. The melt then solidifies to a rigid strip and is removed from the casting surface. This process can produce great savings over rolled product, but only if the properties are not sacrificed. In particular, the as-cast surface must meet the requirements of the intended use without much additional rolling, or the savings is lost.

The rapid solidification of metals to form metal strip by the melt drag process is described in numerous patents, such as U.S. Pat. Nos. 3,522,836; 3,605,863; 4,470,528 and 4,484,614. The process generally comprises forming a meniscus of molten metal at the outlet of a tundish, and dragging a chill surface through the meniscus. Molten metal thereby contacts the chill surface and solidifies thereon to form a thin metal strip.

Melt drag processes involve puddling a molten stream and almost instantaneously accelerating the forming strip from zero velocity to the velocity of the spinning wheel. This acceleration occurs in the process of drawing the strip out of the puddle. Molten metal is left behind as the strip is solidified and withdrawn.

U.S. Pat. No. 4,646,812 shows a non-melt-drag process utilizing a spaced roller on a flat substrate. The patent expressly distinguishes melt drag processes producing thin strip.

Many top rollers are disclosed in the prior art in conjunction with direct-strip forming processes. But these rolls are generally chilled to aid in upper surface solidification or to ride on the solidified portion of the strip to flatten it.

SUMMARY OF THE INVENTION

It is an object of the present invention to provide profile control and surface improvement to direct-cast strip.

In accordance with the objectives, apparatus for casting strip generally include a chill wheel and an open tundish for delivering molten metal to the chill surface. A thin layer of molten metal is dragged by the chill surface, and solidifies as the wheel rotates through the melt pool. The present invention provides a roll skimmer downstream of the tundish for acting to level the upper liquid layer of the solidifying strip. The roll is in communication with the chill surface and is spaced therefrom so that a constant gap is formed therebetween smoothing out dimensional irregularities in the chill surface to produce a constant thickness strip. Rims on either the chill wheel or roll skimmer are effective. The roll skimmers acts on the liquid layer and does not to any extent ride on the solid portion of the strip.

The roll skimmer preferably is driven by the chill wheel and preferably at the same surface speed. The gap is preferably constant thickness along the length of the roll, but can be nonuniform, for example, larger in the middle so that a crowned strip product is formed for rolling.

If the roll skimmer comes in contact with the solid strip interface, sticking may result. A parting agent may then be desirably applied to the roll skimmer or indeed any top roller in a continuous manner. A carbonaceous soot has been found to work rather well. A hydrocarbon fuel is delivered in a perforated pipe and partially burned to produce the soot.

DESCRIPTION OF THE PREFERRED EMBODIMENTS

Figure 1:
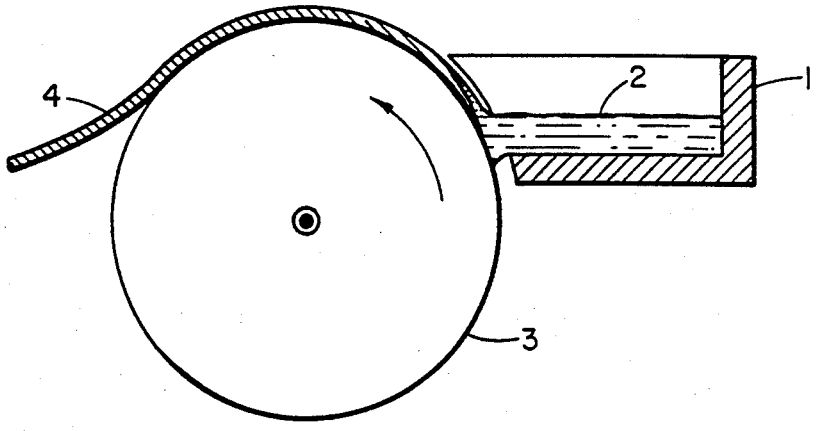
FIG. 1 shows the prior art direct strip forming apparatus.

FIG. 1 shows a melt drag casting apparatus including a chill wheel 3 and an open tundish 1. The tundish delivers molten metal 2 to the chill surface where upon it solidifies to solid strip 4. In forming the strip, several factors (including liquid turbulence and nonuniform heat transfer) may contribute to a nonuniform thickness, both longitudinal and transverse. The present invention skims off excess liquid leading to a uniform upper surface finish and uniform and/or controlled strip thickness.

Figure 2A:
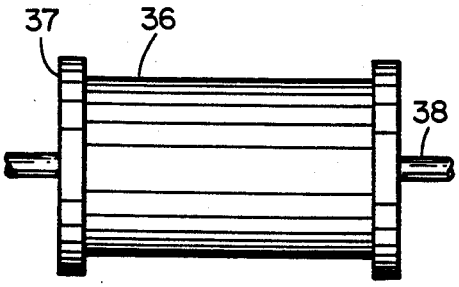
FIGS. 2(*a*) and 2(*b*) show roll skimmers useful in the present invention.
Figure 2B:
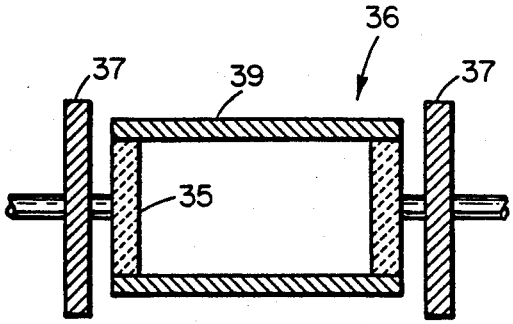
Figure 3:
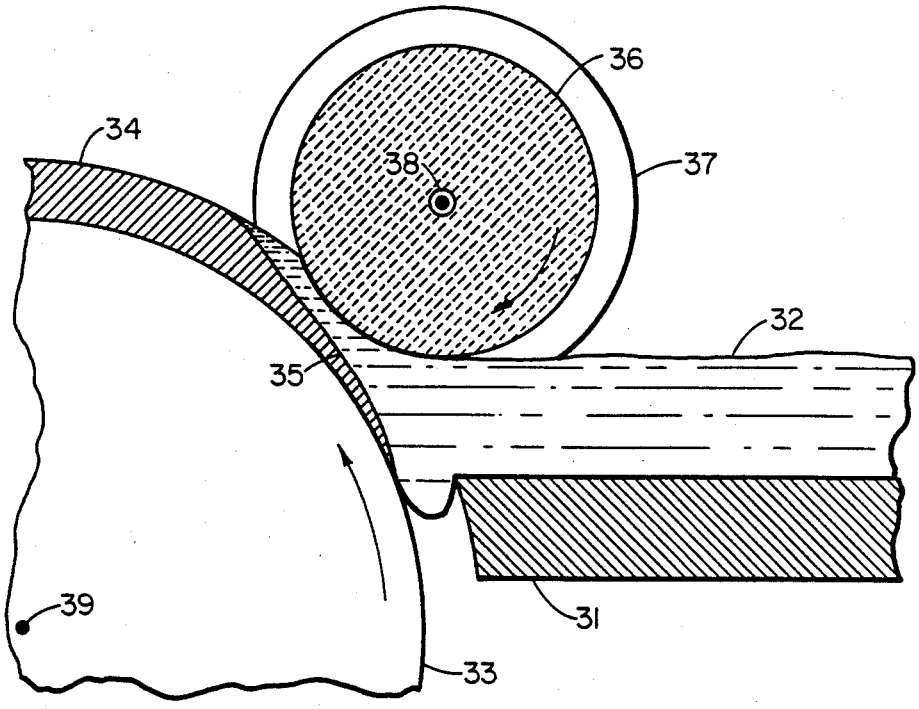
FIG. 3 shows a cross-sectional view of the roll skimmer as operating on the solidifying direct cast strip.

FIGS. 2(*a*), 2(*b*) and 3 show the roll skimmer as part of the casting apparatus. The tundish 31 again delivers the molten metal 32 to the outer surface of chill wheel 33 rotating about an axis 39. The molten metal layer quickly beings to solidify along a solidification front 35 to form a solid strip 34. Roll skimmer 36 rotates about an axis 38 substantially parallel to chill roll axis 39. The roll skimmer is driven by the chill roll 33 through rims 37 in contact with the outer surface of the chill wheel. Rims 37 also provide a fixed gap between the roll skimmer and the chill wheel which serves to dimension the strip profile. The roll skimmer is positioned so that the outer surface thereof is rotated within the molten metal 32 above the solidification front 35.

The roll skimmer is shown in FIG. 2(*a*) with the rims 37 circumferentially around the ends of the cylindrical body portion. The body portion can be either solid or hollow. Alternatively, as shown in FIG. 2(*b*) the rims 37 may be spaced away from the cylindrical body portion 39, so that the rims avoid heat conduction which can deform them. If the body portion is hollow as shown in FIG. 2(*b*), ceramic spacers 35 can also be added to further retard heat convection to the rims. In any event, the rims must have sufficient wear resistance to maintain the gap.

Figure 4:
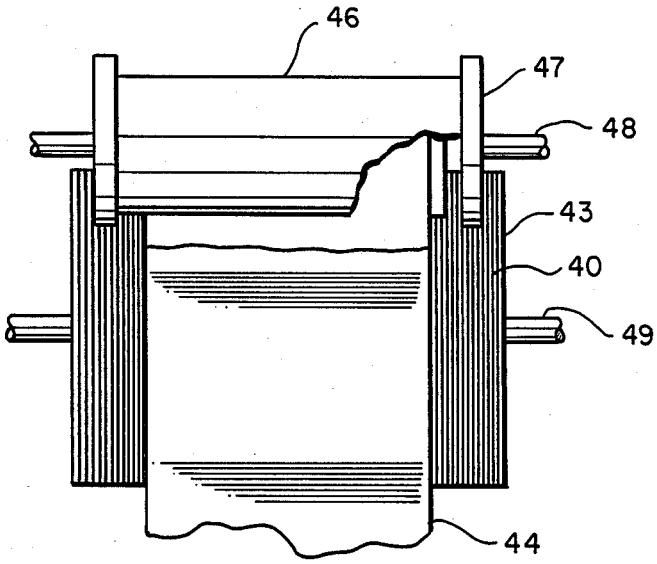
FIG. 4 shows a plan view of the apparatus according to the invention.

FIG. 4 shows a plan view of apparatus according to the invention. The chill wheel 43 has fine grooves 40 in the outer cylindrical surface to aid in casting smooth strip 44. The molten metal is again delivered to the chill wheel rotating about axle 49 along its longitudinal axis. The roll skimmer 46 with rims 47 is rotated about axle 48 along its longitudinal axis. The axes of the chill wheel and roll skimmer are substantially parallel and the outer cylindrical surfaces are likewise giving rise to a substantially rectangular cross section in the strip 44.

Figure 5:
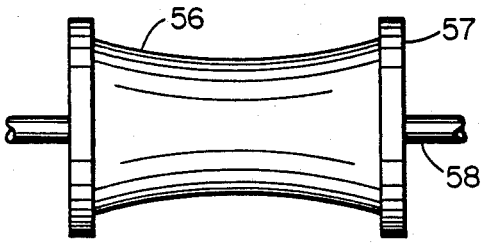
FIGS. 5 and 6 show alternative roll skimmers.

FIG. 5 discloses a roll skimmer 56 having rims 57 and axle 58, but also having an outer cylindrical surface which is slightly convex in longitudinal cross section and symmetric around a transverse cross section taken through the center. This allows the production of a strip product having a central crown which is desirable for subsequent rolling operations.

Figure 6:
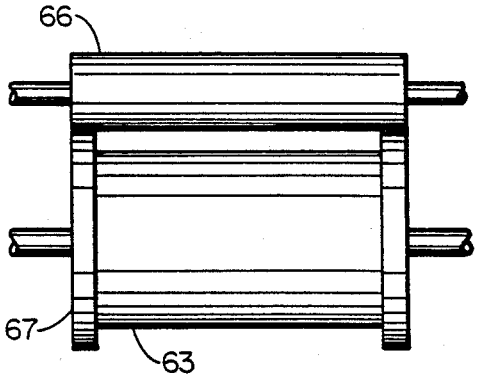

FIG. 6 shows apparatus according to the invention in which the chill wheel 63 has rims 67 to communicate with roll skimmer 66 and provide the constant gap therebetween.

The roll skimmer communicates with the casting surface of the chill wheel to maintain a gap therebetween which is independent of dimensional changes in the wheel brought about by nonuniform thermal conditions. The gap may be nonuniform along the length of the roll to provide a particular cross-sectional shape in the cast strip. The geometry of the gap will generally be replicated in the strip. For example, a thicker gap in the center will result in a rollable, crowned strip.

In many cases, however, the gap will be uniform. The thickness of the gap and the position of the roll skimmer downstream of the tundish are selected such that the skimmer outer surface is in the liquid metal above the solidification front. The solid interface is not uniform across the surface due to variable heat transfer and dendritic growth. Hence, if the gap is too small (or if the roll skimmer were biased too much toward the chill wheel), the roll skimmer would only contact the thickest solidifying portions of the strip. This can cause sticking (which can increase the gap and the strip thickness) and almost surely causes a rough, dimpled surface on the strip.

When operating in the liquid region, the roll skims excess liquid but allows a small amount to pass under the roll. This skimming tends to smooth out the irregularities in the solid interface, creating a smoother surface.

For best operation, it is preferable if the roll skimmer operates at a location downstream of the tundish where less than an average of 50% (more preferably 10–40%) of the liquid/solid layer thickness directly under the roll is liquid.

The roll skimmer is not used to aid solidification of the strip but only to skim the liquid. The roll is uncooled, and is maintained at an elevated temperature resulting from operation of the process or by application of external heat (e.g., from a burner). Preferably, the roll skimmer is preheated to an elevated temperature before casting. During operation, the temperature of the roll skimmer is preferably substantially equal to or above the temperature of the molten metal, but it can operate somewhat below the metal temperature.

The roll skimmer may be driven by the chill wheel or driven independently. The surface speed of the roll skimmer may be the same as, or greater or lesser than the chill wheel. If the rims roll on the chill wheel, a sufficient downward force (by weight of the roll or otherwise) should be applied to maintain contact with the wheel overcoming bumps and hydrodynamic lift but not so much so as to ride on the solid portions of the strip.

Figure 7:
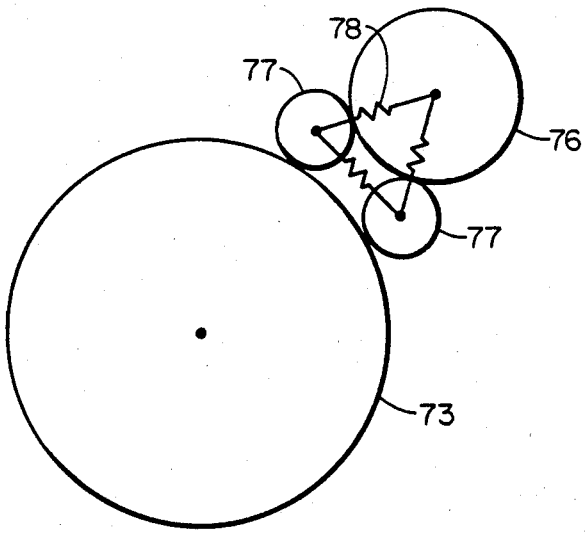
FIG. 7 shows apparatus for varying the gap between the roll skimmer and the chill wheel.

FIG. 7 shows apparatus for varying the gap between the roll skimmer 76 and the chill wheel 73. A pair of guide wheels 77 and a frame 78 are attached to the roll skimmer axle while they ride on the outer surface of the chill wheel. Adjustment means (not shown) between the separate guide wheels or between the guide wheels and the roll skimmer axle can be used to change the length of the frame and consequently the thickness of the gap.

The roll skimmer desirably works only on the molten metal, but occasionally does come in contact with the solid interface. Sticking can then occur. To avoid sticking and the problems caused thereby, a nonstick material may be chosen for the roll skimmer. When casting aluminum, for example, a graphite roll has been used.

Alternatively, we have found that more conventional materials such as steel can be used if a parting agent is continuously applied. Moreover, not only the particular spaced roll skimmer described herein, but also any uncooled top roller positioned partially in the liquid, can benefit from the continuous application of a parting agent.

Solid particles (e.g., graphite powders or molybdenum disulfide), liquid chemicals (e.g., oxide washes) or gaseous combustion products have been used as parting agents. For casting aluminum alloys, a carbonaceous soot has been found acceptable. An acetylene gas, propane gas and a natural gas have been partially combusted to produce the soot. Other hydrocarbon gases should work equally well.

Once sticking occurs, it is hard to overcome. We have found that it is therefore desirable to pretreat the roll skimmer or any other top roller with a soot, wash or spray before operation and then to continuously apply such agent during operation. When casting aluminum, on steel, we have found that a graphite or zirconia wash or spray is an adequate pretreatment. Preheating the roll skimmer or other roll, as with a natural gas burner, is also desirable.

The casting process may be commenced with the roll skimmer or other roll in its final position or elevated above the metal layer. If initially elevated, it is preferably preheated/sooted, driven by independent means and then lowered into the metal layer after casting has begun.

Figure 8:
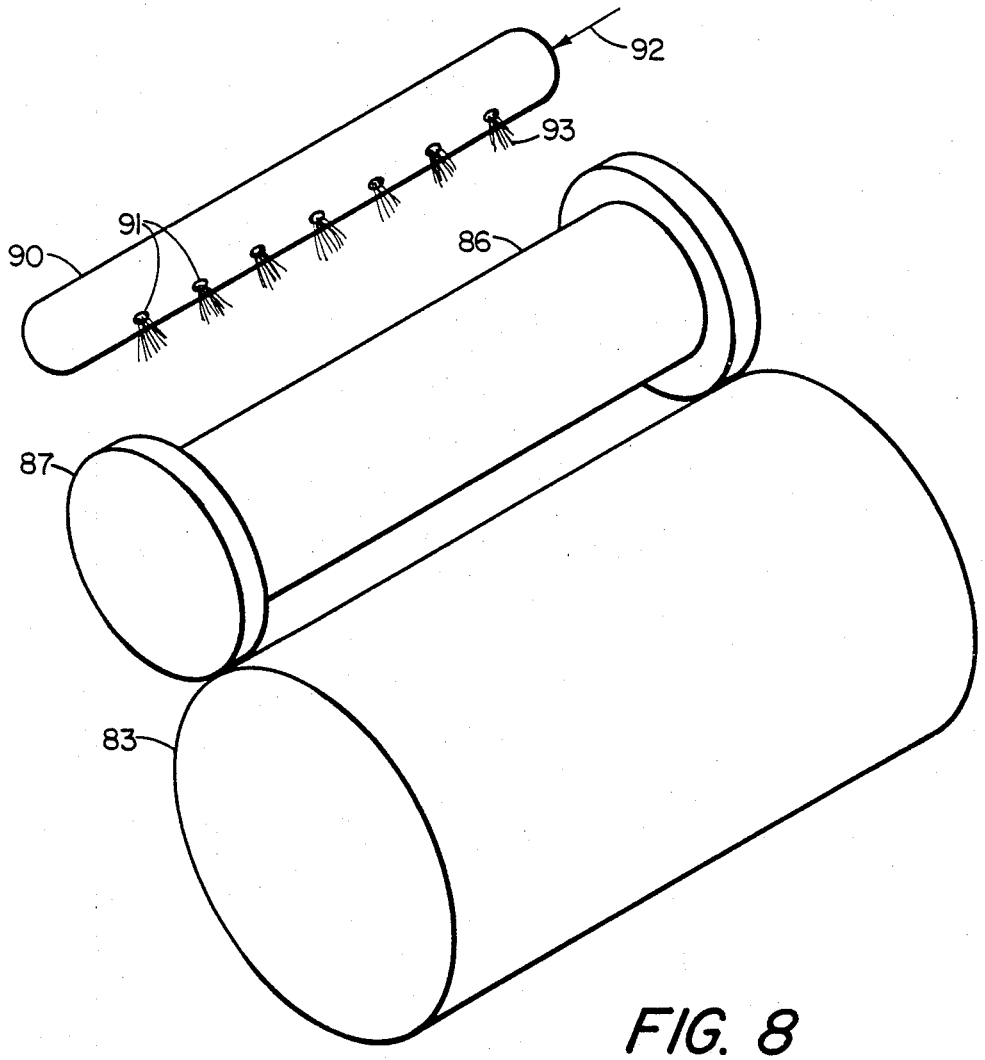
FIG. 8 shows apparatus for applying a parting agent to the roll skimmer of the invention.

The apparatus shown in FIG. 8 has been used to direct a combustible gas flame to the roll skimmer described above. It can also be used with any uncooled top roller rotating partially in the liquid whether or not it is spaced from and in communication with the chill wheel or not. The hydrocarbon gases are passed into a perforated pipe 90 through one end 92 and are combusted as they are forced out perforations 91 toward the roll skimmer 86. The roll skimmer rides on the chill wheel 83 on rims 87 and continuously receives soot from the perforated pipe.

By using the parting agent, more materials for the roll skimmer or other top roller become available. Since we don't have to worry about sticking, the properties such as high temperature strength, controlled or controllable thermal distortion, and thermal shock resistance become the primary concerns.

We claim:

1. Apparatus for direct casting of metal strip including an open tundish for containing molten metal, a rotating chill wheel having an outer cylindrical surface with dimensional irregularities closely adjacent the open tundish to extract a layer of molten metal from the tundish and solidify it to a solid strip on the outer cylindrical surface and an uncooled, cylindrical roll skimmer located downstream of the tundish and having an axis of rotation substantially parallel to the axis of rotation of the chill wheel and being spaced therefrom such that an outer cylindrical surface of the roll skimmer is in contact with the layer of molten metal, wherein the improvement comprises means for communicating the outer cylindrical surface of the roll skimmer with the chill wheel outer cylindrical surface to define a gap of preselected thickness therebetween which does not vary with dimensional irregularities of the outer cylindrical surface of the chill wheel.

2. Apparatus for direct casting of metal strip according to claim 1 wherein the cylindrical roll skimmer has annular rims around the circumference in contact with the outer cylindrical surface of the chill wheel to provide the gap.

3. Apparatus for direct casting of metal strip according to claim 1 wherein the chill wheel has annular rims about the circumference in contact with the outer surface of the roll skimmer to provide the gap.

4. Apparatus for direct casting of metal strip according to claim 1 including means for applying a parting agent to the roll skimmer outer cylindrical surface.

5. Apparatus for direct casting of metal strip according to claim 4 including means for continuously applying the parting agent.

6. Apparatus for direct casting of metal strip according to claim 5 wherein the parting agent is a carbonaceous soot.

7. Apparatus for direct casting of metal strip according to claim 4 wherein the means for applying the parting agent comprises a perforated tube closely adjacent the roll skimmer outer cylindrical surface and means for supplying a hydrocarbon fuel to the perforated tube.

8. Method for direct casting of metal strip comprising extracting molten metal from an open tundish on the outer cylindrical surface of a chill wheel having dimensional irregularities and gradually solidifying it to a solid strip from the chill wheel upwards, providing an uncooled, cylindrical roll skimmer downstream of the tundish having an axis of rotation substantially parallel to the axis of rotation of the chill wheel, positioning the roll skimmer such that it contacts the molten metal above the solidifying strip, rotating the roll skimmer to smooth the molten metal and to provide gauge control, and wherein the improvement comprises communicating the outer cylindrical surface of the roll skimmer with the chill wheel outer cylindrical surface to define a gap therebetween which does not vary with dimensional irregularities of the chill wheel outer surface.

9. Method for direct casting of metal strip according to claim 8 including providing the cylindrical roll skimmer with annular rims around the circumference in contact with the outer cylindrical surface of the chill wheel to provide the gap and driving the roll skimmer with the chill wheel.

10. Method for direct casting of metal strip according to claim 8 including providing the chill wheel with annular rims about the circumference in contact with the outer surface of the roll skimmer to provide the gap and driving the roll skimmer with the chill wheel.

11. Method for direct casting of metal strip according to claim 8 including applying a parting agent to the roll skimmer outer cylindrical surface.

12. Method for direct casting of metal strip according to claim 11 including applying the parting agent prior to contact with the molten metal.

13. Method for direct casting of metal strip according to claim 11 including continuously applying the parting agent during casting.

14. Method for direct casting of metal strip according to claim 13 wherein the parting agent is a carbonaceous soot or graphite powder.

15. Method for direct casting of metal strip according to claim 12 including supplying a hydrocarbon fuel to a perforated tube closely adjacent the roll skimmer outer cylindrical surface and partially burning the hydrocarbon fuel to produce soot.

* * * * *